US005240083A

United States Patent [19]

Lyon

[11] Patent Number: 5,240,083

[45] Date of Patent: Aug. 31, 1993

[54] DEVICE FOR REMOVING DRILLHOLE DEBRIS

[75] Inventor: Leland H. Lyon, Roanoke, Va.

[73] Assignee: Ingersoll-Rand Company, Woodcliff Lake, N.J.

[21] Appl. No.: 871,424

[22] Filed: Apr. 21, 1992

[51] Int. Cl.[5] ..... E21B 21/00

[52] U.S. Cl. ..... 175/324; 175/340

[58] Field of Search ..... 175/296, 312, 60, 52, 175/66, 100, 68, 324, 93

[56] References Cited

U.S. PATENT DOCUMENTS

| | | | |
|---|---|---|---|
| 2,894,725 | 7/1959 | Baker | 175/312 |
| 2,898,086 | 8/1959 | Freeman, Jr. et al. | 175/312 |
| 2,920,872 | 1/1960 | Baur et al. | 175/324 |
| 2,937,619 | 5/1960 | Kurt . | |
| 3,198,256 | 8/1965 | Kirby, II | 175/312 |
| 4,084,646 | 4/1978 | Kurt . | |
| 4,189,012 | 2/1980 | Garrett | 175/312 |
| 4,436,166 | 3/1984 | Hayatdavoudi et al. | 175/324 |
| 4,688,650 | 8/1987 | Hayatdavoudi et al. . | |
| 4,705,119 | 11/1987 | Kostylev et al. | 175/296 |

*Primary Examiner*—Ramon S. Britts
*Assistant Examiner*—Frank S. Tsay
*Attorney, Agent, or Firm*—John J. Selko

[57] ABSTRACT

A device for use within a backhead of a down-the-hole percussive drill, for removing debris from a drillhole, includes a separator for separating water and other matter from the percussive fluid prior to the percussive fluid actuating the piston of the drill. The water and other matter are exhausted out the drill bit, to remove the debris. The device includes a one-way flow valve to prevent backflow of debris and water into the drillhead during periods when the percussive fluid flow ceases. The device can be added to existing drill backheads, or included as part of newly manufactured units.

20 Claims, 2 Drawing Sheets

DEVICE FOR REMOVING DRILLHOLE DEBRIS

BACKGROUND OF THE INVENTION

This invention relates generally to rock drills and more particularly to pneumatically operated percussive drills of the type adapted to be inserted into the drillhole being drilled. Such a drill is commonly known as a "down-the-hole" drill (DHD).

Many applications for down-the-hole drills require that liquids such as water, and other matter, be injected into the drill air supply to provide improved hole cleaning and stabilization. Typically, the volume of liquids injected can range from about 2.0 gallons per minute to about 15.0 gallons per minute. When water is injected into the air flow for a DHD, an appreciable loss in penetration rate results for a given pressure. One approach to avoiding this penetration rate loss is to separate the water, and other matter, from the percussive fluid in the drill string at or near the drill itself, before the percussive fluid actuates the drill piston. This separated water and other matter can then be exhausted into the drillhole to effect debris removal.

One such device for accomplishing this separation is disclosed in a pending U.S. patent application, Ser. No. 07/766,866, filed Nov. 29, 1991, entitled "A DEVICE FOR REMOVING DEBRIS FROM A DRILLHOLE" of which I am a co-inventor. This device positions a separator outside the DHD proper, adjacent the backhead of the drill. It would be useful if there were such separator device that is adapted to fit within existing drill backheads, so that the separator can be simply added to the drill backheads, as an add-on unit or as part of the complete drill, for newly manufactured units.

The foregoing illustrates limitations known to exist in present down-the-hole drilling technology. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an improved device for removing drillhole debris that can be added to an existing drill backhead Such device separates a mixture of pneumatic fluid and other matter, flowing in a percussive, fluid-actuated, down-the-hole drill, into a first, pneumatic fluid component for actuating said drill, and into a second, heavier, exhaust component for removing drillhole debris, The device includes mounting means for mounting the device within a bore of a backhead of a drill; separator means for forming, in combination with the backhead, a separator for separating the mixture into first and second components; first passageway means on the device for fluidly transmitting the first component to fluid passageways on the drill, for actuating the drill; and second passageway means on the device for fluidly transmitting the second component, apart from the first component, to fluid exhaust passageways on the drill, for removing drillhole debris.

In a second aspect of the present invention, this is accomplished by providing a down-the-hole drill having the separator already incorporated into the backhead of the drill.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
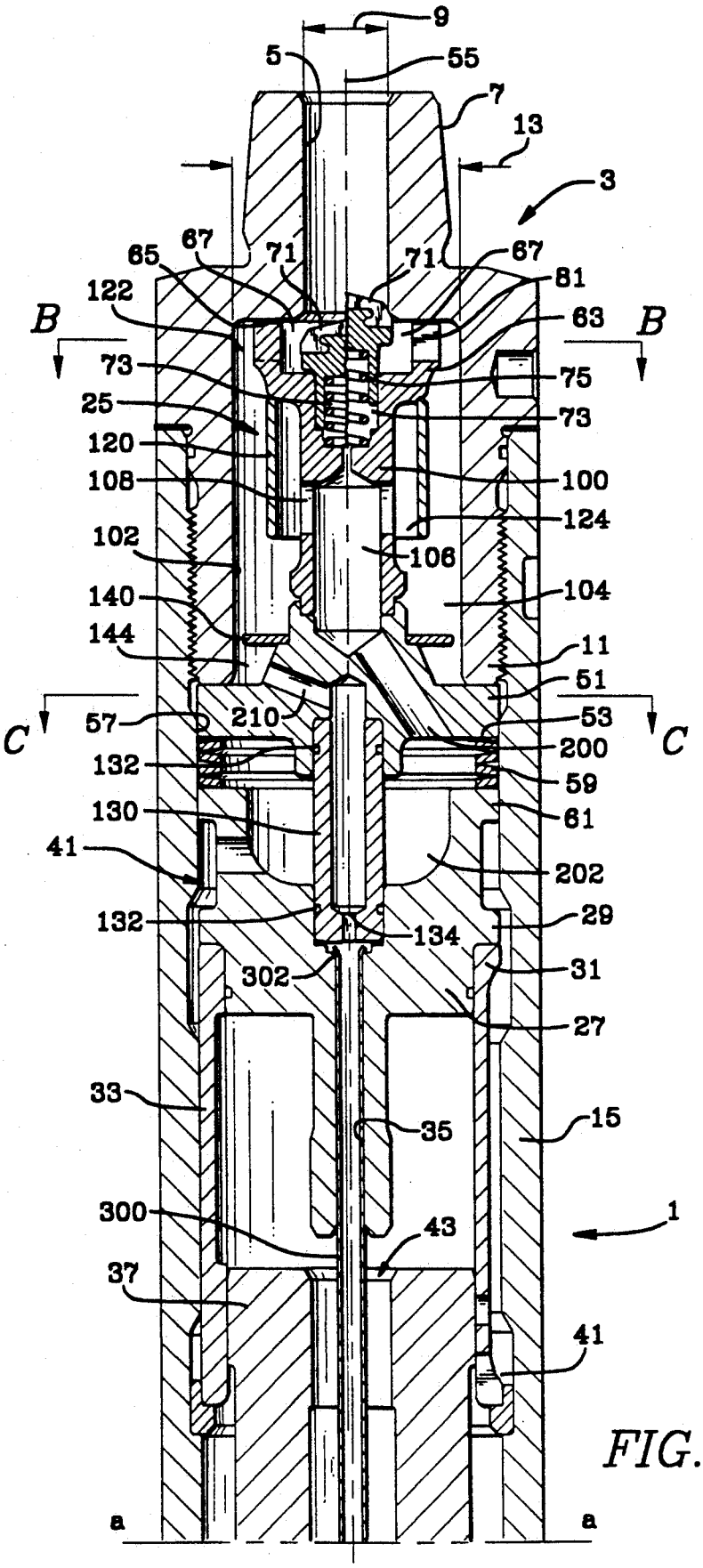
FIG. 1 is a split view of a longitudinal section of the top part of the invention, showing a check valve in the open position to the left of the centerline, and in a closed position to the right of the centerline, the section being taken along the line A—A of FIG. 2.
Figure 1A:
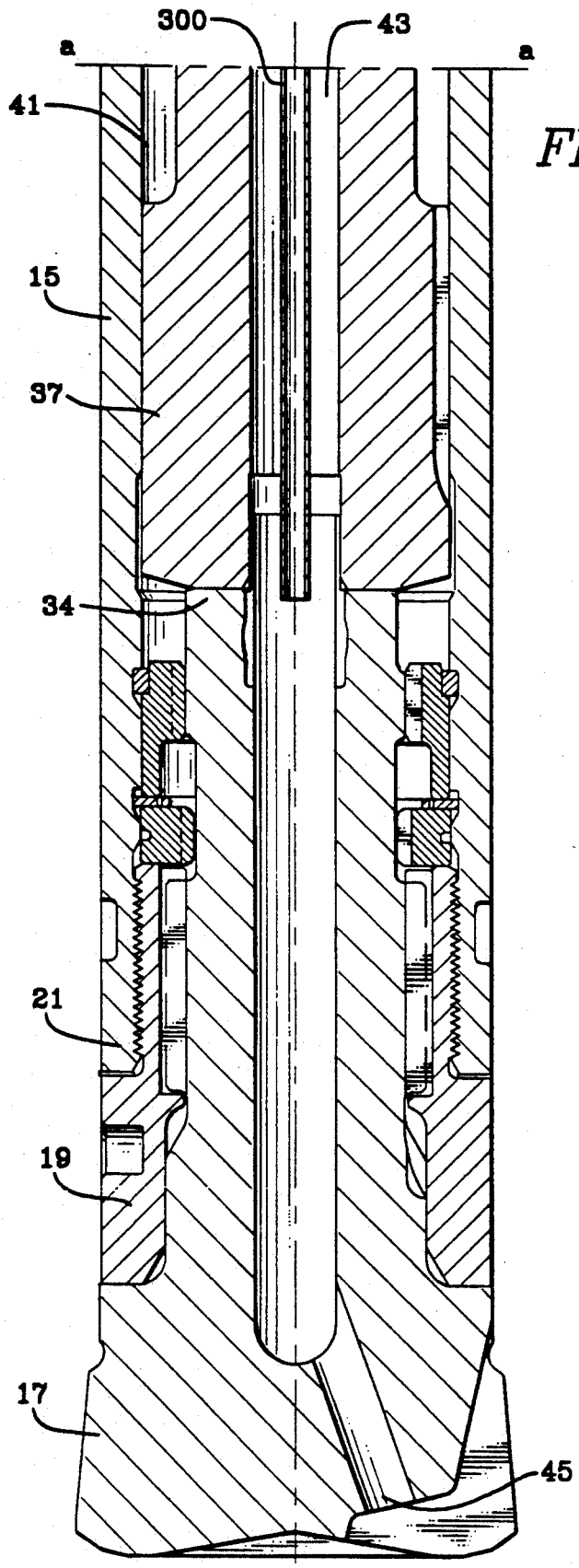
FIG. 1A is a continuation of the bottom part of the invention along the same section as in FIG. 1.

Referring to FIG. 1, there is shown the down-the-hole-drill 1 having a backhead 3, with an axial bore 5 extending therethrough. Backhead 3 has a top end 7 adapted to threadably connect to a drill string (not shown) through which flows a mixture of percussive pneumatic fluid (usually air) and other matter, such as water, oil or solid particles (such as rust) from the drill string. Bore 5 adjacent the top end 7 of backhead 3 has a first diameter 9, and adjacent bottom end 11 of backhead 3 bore 5 has a second, larger diameter 13, as is conventional. Bottom end 11 of backhead 3 is threadably connected to drill casing 15. Percussive drill bit 17 is mounted within chuck 19 (FIG. 1A), which is threadably connected to the bottom end 21 of casing 15, as is conventional.

The separator of this invention, shown generally as 25, is positioned in the larger diameter portion 13 of bore 5, of backhead 3, as described hereinafter.

A fluid distributor 27 is disposed within casing 15 towards bottom end 11 of backhead 3. The distributor 27 slides into place when backhead 3 is unscrewed and the separator 25 is removed. Distributor 27 is held in place by shoulder 29 positioned against the upper end 31 of cylinder 33 in casing 15, as is conventional.

An axial bore 35 is provided in the distributor 27 to provide means for transmitting fluid and separated other matter through the remainder of the impact apparatus, as described hereinafter.

Piston 37 reciprocates within casing 15 and impacts against the top end 34 of drill bit 17, as is well known. Extending through casing 15 are a first plurality of passageways, shown generally as 41, for fluidly transmitting fluid to actuate the piston 37. As is well known, these passageways are, in part, formed by undercuts and apertures in the casing 15 and cylinder 33, as is conventional.

Also extending through casing 15 is a second plurality of passageways (called exhaust fluid passageways herein), shown generally as 43, for fluidly transmitting exhaust fluid through the drill 1, for drillhole debris removal, As is well known, first and second passageways 41, 43 are separate from each other, and transmit fluid separately without mixing the actuating fluid and the exhaust fluid, at least until after the piston 37 is actuated. Exhaust fluid passageways 43 include an axial bore 35 through distributor 27, piston 37, and drill bit 17, to an exhaust port 45 on drill bit 17, as is conventional.

Separator 25, shown generally as 25, is known as a cyclonic separator that utilizes cyclonic fluid flow and reversal of fluid direction to achieve the separation desired. Separator 25 is mounted within bore 5 of backhead 3 by means of flange 51 that is clamped between bottom end 11 of backhead 3 and top end of a drill portion 53 therebelow. Flange 51 extends radially from centerline 55 of bore 5 to contact inner surface 57 of casing 15. Flange 51 rests upon spring bias means 59 that is mounted on top of shoulder 61 of distributor 27. Separator 25 can be removed by unscrewing backhead 3 from casing 15. It should be understood that separator 25 can be inserted into an existing drill assembly or installed as part of a new drill manufacture.

Separator 25 includes an inducer means 63 extending radially from centerline 55 to contact an internal surface of bore 5, which internal surface is a shoulder portion 65 connecting the smaller and larger diameter bores 9 and 13. In combination with bore 5, inducer 63 defines an inlet chamber 67, for receiving fluid mixture flowing from the drill string (not shown).

Positioned within inlet chamber 67 is a conventional check valve 71, for the purpose of closing bore 5, when fluid flow stops, so as to prevent backflow of water and debris from the drillhole into the drill. Check valve 71 is slidably positioned in an axial bore 73 in inducer 63, with a spring bias 75 acting against the bottom of bore 73 to move valve 71 into contact with shoulder 65, when flow ceases.

Figure 2:
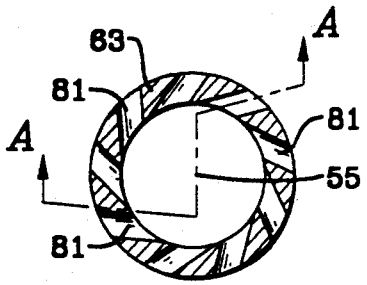
FIG. 2 is a section through FIG. 1, along lines B—B of FIG. 1.

Inducer 63 includes a plurality of radially extending apertures 81 extending in a radial direction with respect to centerline 55. As shown in FIG. 2, apertures 81 are preferred to be tangentially disposed with respect to centerline 55, so as to cause a tangential flow of fluid passing through apertures 81. Apertures 81 can also be radially disposed with respect to centerline 55.

Connected to a bottom surface of inducer 63 is a hollow focus tube 100, that extends downwardly, and concentrically along centerline 55 to sealingly connect to top a surface of flange 51. Hollow focus tube 100 has an external surface that forms, in combination with inner surface 102 of backhead 3, formed by bore 5 at diameter 13, an annular separator chamber 104. Focus tube 100 also has an internal surface that forms an internal gallery 106 extending concentrically downward along centerline 55. A plurality of apertures 108 in focus tube 100 fluidly connect separator chamber 104 and gallery 106. A single aperture 108 will also work.

A hollow shield tube 120 is connected to a bottom surface of inducer 63, and extends downwardly and concentrically along centerline 55. Shield tube 120 is telescopically spaced over focus tube 100 a sufficient distance to cover apertures 108. Thus, shield tube 120 divides separator chamber into a first, annular, entry chamber 122, for receiving downward flow of fluid from inducer 63, and a second, annular, exit chamber 124, for receiving upward flow of fluid, as hereinafter described. Shield tube 120 prevents entry of downward flowing fluid into apertures 108, and only permits upward flowing fluid to enter apertures 108, after the fluid has had most of the heavy matter removed therefrom, as described hereinafter.

Sealingly connected to a bottom surface of flange 51 is a hollow orifice tube 130 that extends downwardly and concentrically along centerline 55, to sealingly engage bore 35 through distributor 27. Elastic seals 132 are positioned at the top and bottoms end of orifice tube 130. Orifice tube 130 has a restricted opening 134 at its bottom end, to limit fluid flow, somewhat. This restricted opening assures that most of the fluid flowing through the drill will serve to actuate the piston 37.

Connected to a lower portion of focus tube 100 is an annular baffle 140 extending radially toward inner surface 102 of backhead 3 formed by bore 5. Baffle 140 does not extend far enough to contact inner surface 102 but is spaced therefrom. Baffle 140, in combination with inner surface 102 and flange 51 forms a collection chamber 144 below baffle 140, for collecting separated matter as described hereinafter. The spacing of baffle 140 from inner surface 102 forms the entry into collection chamber 144.

A first plurality of apertures, 200 extends through flange 51 for fluidly connecting internal gallery 106 to distributor 27 by means of drill chamber 202, formed by flange 51 and distributor 27.

A second plurality of apertures 210 extend through flange 51 for fluidly connecting collection chamber 144 to orifice tube 130.

Figure 3:
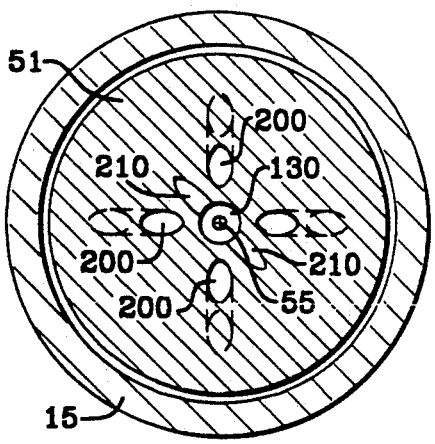
FIG. 3 is a section through FIG. 1, along lines C—C of FIG. 1.

As shown in FIG. 3, a plurality of apertures 200 are spaced around centerline 55, but a single aperture will work. Also, a plurality of apertures 210 are shown space around centerline 55, but a single aperture will work.

In operation, the mixture of percussive fluid and other matter flows axially downwardly into inlet chamber 67 and against inducer 63, where it is deflected to a tangential and radially outward direction into annular separator chamber 104, to impact tangentially against inner surface 102 of backhead 3. Thereafter, the percussive fluid mixture flows downwardly and circularly, in a vortex fashion, through first annular entry chamber 122, causing separation of at least some of the heavier other matter from the percussive fluid mixture. Such separated matter flows downward along inner surface 102 of backhead to collection chamber 144. At the lower end of annular separator chamber 104, the percussive fluid mixture strikes baffle 140, reverses its flow to an upward direction, causing separation of more of the other heavier matter from percussive fluid mixture, and collection thereof in collection chamber 144.

The percussive fluid is now substantially divided into a first pneumatic fluid component, for actuating piston 37, and a second, primarily liquid and solid, exhaust component for removing drillhole debris. The first component flows upwardly along the outer surface of focus tube 100 through second annular exit chamber 124, and into collection gallery 106 of focus tube 100. Thereafter, it flows through drill chamber 202, distributor 27 and passageways 41 to actuate piston 37, as is conventional.

The second, separated component of the mixture flows through apertures 210 in flange 51 to orifice tube 130 an thereafter to exhaust passageways 43 and exhaust port 45 of drill bit 17, for debris removal, as is conventional.

In order to reduce wear on the interior of the drill 1 by the separated, second exhaust component, an elongated hollow tube 300 can be removably inserted into axial bore 35 to extend through the piston 37, to an optional distance, preferably to about the top end 39 of drill bit 17. Upper end 302 of tube 300 is flared, so as to fit into the mouth of bore 35 in distributor 29 immediately below the bottom end of orifice tube 130.

Having described the invention, what is claimed is:

1. A device for separating a mixture of pneumatic fluid and other matter, flowing in a percussive, fluid-actuated, down-the-hole drill, into a first, pneumatic fluid component for actuating said drill, and into a second, heavier, exhaust component for removing drillhole debris comprising:

(a) mounting means for mounting said device within a bore of a backhead of said drill, along a centerline of said bore;

(b) separator means on said device for forming, in combination with said backhead, a separator for separating said mixture into said first and second components;

(c) first passageway means on said device for fluidly transmitting said first component to fluid passageways on said drill, for actuating said drill;

(d) second passageway means on said device for fluidly transmitting said second component, apart from said first component, to fluid exhaust passageways on said drill, for removing said drillhole debris; and check valve means on said device, for contacting an internal surface of said bore, for closing said bore when flow of said mixture ceases.

2. The invention of claim 1 in which said mounting means comprises:

(a) a flange member adapted to be clamped between a bottom end of said backhead and a top end of a drill portion therebelow, said flange radially extending from said centerline for contact with a inner surface of said casing; and (b) a hollow orifice tube sealingly connected to a bottom surface of said flange member, extending downwardly from said flange member concentrically along said centerline, for sealing engagement with a bore through a distributor of said drill.

3. The invention of claim 1 in which said separator means comprises:

(a) inducer means on said device extending radially from said centerline, for contacting said internal surface of said bore and, in combination therewith, for defining an inlet chamber in said device, said inducer means including inducer passageway means for fluidly transmitting said mixture from said inlet chamber into said separator means;

(b) a hollow focus tube connected to a bottom surface of said inducer means, extending downwardly from said inducer means, and sealingly connected to a top surface of said flange member, said focus tube having an external surface, in combination with an inner surface of said bore, forming an annular separator chamber, said focus tube having an inner surface forming an internal gallery extending concentrically along said centerline;

(c) aperture means in said focus tube for fluidly connecting said separator chamber to said internal gallery;

(d) a hollow shield tube connected to a bottom surface of said inducer means, extending concentrically along said centerline and telescopically spaced over said focus tube a sufficient distance to cover said aperture means, said shield tube adapted to divide said separator chamber into a first, annular entry chamber for downward flow of said mixture and a second annular exit chamber for upward flow of said first component;

(e) baffle means connected to a lower portion of said focus tube, extending radially therefrom, adapted to be spaced from said inner surface of said bore, to cause reversal of flow of said mixture and to cause substantial separation of said first and second components; and (f) collection chamber means below said baffle means for collecting said separated second component;

4. The invention of claim 3 in which said first separator passageway means comprises:

(a) first aperture means in said flange member for fluidly connecting said internal gallery to a distributor member on said drill.

5. The invention of claim 4 in which said second separator passageway means comprises:

(a) second aperture means in said flange member for fluidly connecting said collection chamber to said orifice tube.

6. The invention of claim 1 in which said first component is substantially all pneumatic fluid.

7. The invention of claim 6 in which said pneumatic fluid is air.

8. The invention of claim 7 in which said second component is substantially all other matter.

9. The invention of claim 8 in which said other matter is substantially all water.

10. The invention of claim 9 in which said other matter includes solid particles from a drill string bore.

11. The invention of claim 10 in which said other matter includes oil.

12. A device for separating a mixture of pneumatic fluid and other matter, flowing in a percussive, fluid-actuated, down-the-hole drill, into a first, drill-actuating component and into a second, drillhole debris removing component, said drill having a backhead, with a top end adapted for connection to a drill string and a bottom end adapted for connection to a drill casing, said backhead having a bore therethrough, said bore having a first diameter adjacent said top end, and a second, larger diameter adjacent a bottom end comprising:

(a) mounting means for mounting said device within said bore, along a centerline of said bore;

(b) inducer means on said device radially extending from said centerline, for contacting said internal surface of said bore, for defining an inlet chamber in said device;

(c) separator means on said device, below said inducer means, for forming an annular separator chamber, in combination with an internal surface of said bore, for causing flow reversal of mixture in said annular separator chamber, to separate said first and second components, and for forming a collection chamber for said second component;

(d) check valve means in said inlet chamber, for contacting said internal surface of said bore, for closing said bore when flow of said mixture ceases, and for opening said bore when flow of said mixture occurs;

(e) inducer passageway means through said inducer means for fluidly transmitting said mixture from said inlet chamber to said annular separator chamber;

(f) first passageway means on said device for fluidly transmitting said first component from said annular separator chamber to fluid passageways of said drill, for actuating said drill; and (g) second passageway means on said device for fluidly transmitting said second component from said collection chamber to fluid exhaust passageways of said drill, for removing said drillhole debris.

13. The invention of claim 12 in which said separator means further comprises:

a) a hollow focus tube connected to a bottom surface of said inducer means, extending downwardly from said inducer means, and sealingly connected to a top surface of a mounting means flange member, said focus tube having an external surface, in combination with said inner surface of said bore, forming said annular separator chamber, said focus tube having an inner surface forming an internal gallery extending concentrically along said centerline;

(b) aperture means in said focus tube for fluidly connecting said annular separator chamber to said internal gallery;

(c) a hollow shield tube connected to a bottom surface of said inducer means, extending concentrically along said centerline and telescopically spaced over said focus tube a sufficient distance to cover said aperture means, said shield tube adapted to divide said annular separator chamber into a first, annular entry chamber for downward flow of said mixture and a second annular exit chamber for upward flow of said first component.

14. The invention of claim 12 in which said mounting means further includes a spring bias means between said flange member and said bottom end of said backhead.

15. A percussive, down-the-hole drill actuated by a mixture of pneumatic fluid and other matter comprising:

(a) a backhead having a top end adapted for connection to a drill string and a bottom end removably connected to a top end of a down-the-hole drill casing, said backhead having a bore therethrough;

(b) reciprocal piston means in said casing, for reciprocating back and forth;

(c) drill bit means mounted in a bottom end of said casing, for receiving impact force from said piston;

(d) first fluid passageway means in said drill casing, for transmitting percussive fluid to actuate said piston;

(e) second fluid passageway means in said drill casing for transmitting exhaust fluid to remove drillhole debris;

(f) separator means within said backhead, for separating said mixture into a first, pneumatic fluid component for actuating said drill, and into a second, heavier, exhaust component for removing drillhole debris, said separator means positioned between said top end of said backhead and said top end of said casing.

16. The invention of claim 15 in which said separator means comprises:

(a) mounting means for mounting said separator means within said bore, along a centerline of said bore;

(b) inducer means on said separator radially extending from said centerline, contacting said internal surface of said bore, adjacent said top end of said backhead for defining an inlet chamber in said separator;

(c) an annular separator chamber means, below said inducer means, for causing flow reversal of said mixture in said annular separator chamber, to separate said first and second components, and for forming a collection chamber for said second component;

(d) check valve means in said inlet chamber, for contacting said internal surface of said bore, for closing said bore when flow of said mixture ceases, and for opening said bore when flow of said mixture occurs;

(e) inducer passageway means through said inducer means for fluidly transmitting said mixture from said inlet chamber to said annular separator chamber;

(f) first passageway means on said separator for fluidly transmitting said first component from said annular separator chamber to said first fluid passageways in said drill casing, for actuating said drill; and (g) second passageway means on said separator for fluidly transmitting said second component from said collection chamber to said second fluid exhaust passageways in said drill casing, for removing said drillhole debris.

17. The invention of claim 16 in which said mounting means comprises:

(a) a flange member clamped between said bottom end of said backhead and said top end of said drill casing, said flange member radially extending from said centerline to contact an inner surface of said casing; and (b) a hollow orifice tube sealingly connected to a bottom surface of said flange member, extending downwardly from said flange member concentrically along said centerline, said orifice tube sealingly engaged with a bore through a fluid distributor member of said drill.

18. The invention of claim 17 in which said separator means further comprises:

(a) a hollow focus tube connected to a bottom surface of said inducer means, extending downwardly from said inducer means, and sealingly connected to a top surface of said mounting flange member, said focus tube having an external surface, in combination with said inner surface of said bore, forming said annular separator chamber, said focus tube having an inner surface forming an internal gallery extending concentrically along said centerline;

(b) aperture means in said focus tube for fluidly connecting said annular separator chamber to said internal gallery;

(c) a hollow shield tube connected to a bottom surface of said inducer means, extending concentrically along said centerline and telescopically spaced over said focus tube a sufficient distance to cover said aperture means, said shield tube dividing said annular separator chamber into a first, annular entry chamber for downward flow of said mixture and a second annular exit chamber for upward flow of said first component;

(d) baffle means connected to a lower portion of said focus tube, extending radially therefrom, spaced from said inner surface of said bore, to cause reversal of flow of said mixture and to cause substantial separation of said first and second components; and (e) collection chamber means below said baffle means for collecting said separated second component;

19. The invention of claim 18 in which said mounting means further includes a spring bias means between said flange member and said bottom of said backhead.

20. The invention of claim 19 in which said second fluid exhaust in said drill casing passageways further includes:

(a) an axial bore along a centerline through said fluid distributor member, said piston and said drill bit, to an exhaust port on said drill bit; and (b) an elongated hollow tube extending through said axial bore from said fluid distributor to a position adjacent to a top end of said drill bit, whereby flow of said second exhaust component is contained within said hollow tube.

* * * * *